US006439746B2

(12) United States Patent
Huang

(10) Patent No.: US 6,439,746 B2
(45) Date of Patent: Aug. 27, 2002

(54) COLLAPSIBLE LAMPSHADE FOR A TABLE LAMP

(75) Inventor: Chin-Feng Huang, Taipei (TW)

(73) Assignee: Groton Industries, Inc., Taipei (TW)

( * ) Notice: Subject to any disclaimer, the term of this patent is extended or adjusted under 35 U.S.C. 154(b) by 0 days.

(21) Appl. No.: 09/862,829

(22) Filed: May 22, 2001

(51) Int. Cl.[7] ..... F21V 1/06
(52) U.S. Cl. ..... 362/352; 362/450
(58) Field of Search ..... 362/352, 358, 362/360, 367, 450

(56) References Cited

U.S. PATENT DOCUMENTS 671,814 A * 4/1901 Catlin ..... 362/358
867,871 A * 10/1907 Boesen ..... 362/360
877,784 A * 1/1908 Lewis ..... 362/322
1,335,640 A * 3/1920 Beales ..... 362/360
1,363,782 A * 12/1920 Handel ..... 362/360
1,923,555 A * 8/1933 Provenzano ..... 362/358
3,162,377 A * 12/1964 Ozeki ..... 362/450

* cited by examiner

*Primary Examiner*—Alan Cariaso
*Assistant Examiner*—Sharon Payne
(74) *Attorney, Agent, or Firm*—Jackson Walker L.L.P.

(57) ABSTRACT

A lampshade for a table lamp has a top plate, multiple panel frames and multiple shade panels. Each panel frame has a panel support and at least one panel clip to hold one of the shade panels. The top plate has an elongated hole to engage with a hook formed on each panel frame. A through hole is defined in the panel support of each panel frame. A threaded stud extends from each panel frame and through the through hole in the adjacent panel frame. A nut is screwed onto each threaded stud to detachably connect adjacent panel frames. Consequently, the panel frames can be disassembled from the top plate, and the panel frames are detachable. The lampshade can be disassembled into multiple parts. The packaging and storage sizes of the lampshade are reduced. To transport or to store the lampshade becomes more convenient.

9 Claims, 7 Drawing Sheets

COLLAPSIBLE LAMPSHADE FOR A TABLE LAMP

BACKGROUND OF THE INVENTION

1. Field of the Invention

The present invention relates to a lampshade for a table lamp, and more particularly to a collapsible lampshade that can be disassembled into several parts to reduce the space needed during shipment and/or for storage of the lampshade.

2. Description of Related Art

With reference to FIGS. 7 to 9, a conventional lampshade for a table lamp in accordance with the prior art comprises a top plate (30), multiple panel frames (32) and multiple shade panels (36). The top plate (30) is mounted on the top of a table lamp. A threaded rod (38) projecting from the top of the lamp extends through a through hole (not numbered) defined in the center of the top plate (30). One end of each panel frame (32) is secured to the top plate (30). The other end of each panel frame (32) is curved as a panel support (322). At least one panel clip (324) is attached to the panel support (322) of each panel frame (32). The free end of the panel support (322) of each panel frame (32) is securely connected to the adjacent panel frame (32) with a welding process. Accordingly, a skeletal lampshade frame constructed with the top plate (30) and the panel frames (32) is achieved. A shade panel (36) is inserted into each panel frame (36) and supported by the panel support (322) and the panel clips (324).

To install the lampshade on a table lamp, the threaded rod (38) is inserted through the through hole in the top plate (30). A cap (37) covers the top plate (30) and the top edge of the each shade panel (36) to hold the shade panels (36). A nut (39) is then screwed onto the threaded rod (38). Consequently, the lampshade is secured to the table lamp.

However, because the panel frames (32) are permanently attached to each other and to the top plate (30), the lampshade cannot be disassembled and reassembled easily. Packing and storing the lampshade is inconvenient because the lampshade is large and cannot be temporarily reduced in size.

To overcome the shortcomings, the present invention tends to provide a detachable lampshade to mitigate or obviate the aforementioned problems.

SUMMARY OF THE INVENTION

The main objective of the invention is to provide a collapsible lampshade for table lamps and floor lamps in order to reduce the volume of the item during transport and storage. The lampshade has a top plate, multiple panel frames and multiple shade panels. Each panel frame has a panel support and at least one panel clip to hold one of the shade panels. The top plate has elongated holes near the edge which to engage with a hook formed from the end of each panel frame, such that the panel frames can be disassembled from the top plate. A through hole is defined in the end of the panel support of each panel frame. A threaded stud extends from each panel frame at the point that it is joined to the adjacent panel frame and through the through hole in the adjacent panel frame. A nut is screwed onto each threaded stud to detachably assemble the adjacent panel frames. Consequently, the lampshade can be disassembled into multiple parts. The package and storage of the lampshade are reduced. To transport and to store the lampshade become more convenient.

Other objects, advantages and novel features of the invention will become more apparent from the following detailed description when taken in conjunction with the accompanying drawings.

DETAILED DESCRIPTION OF PREFERRED EMBODIMENT

Figure 1:
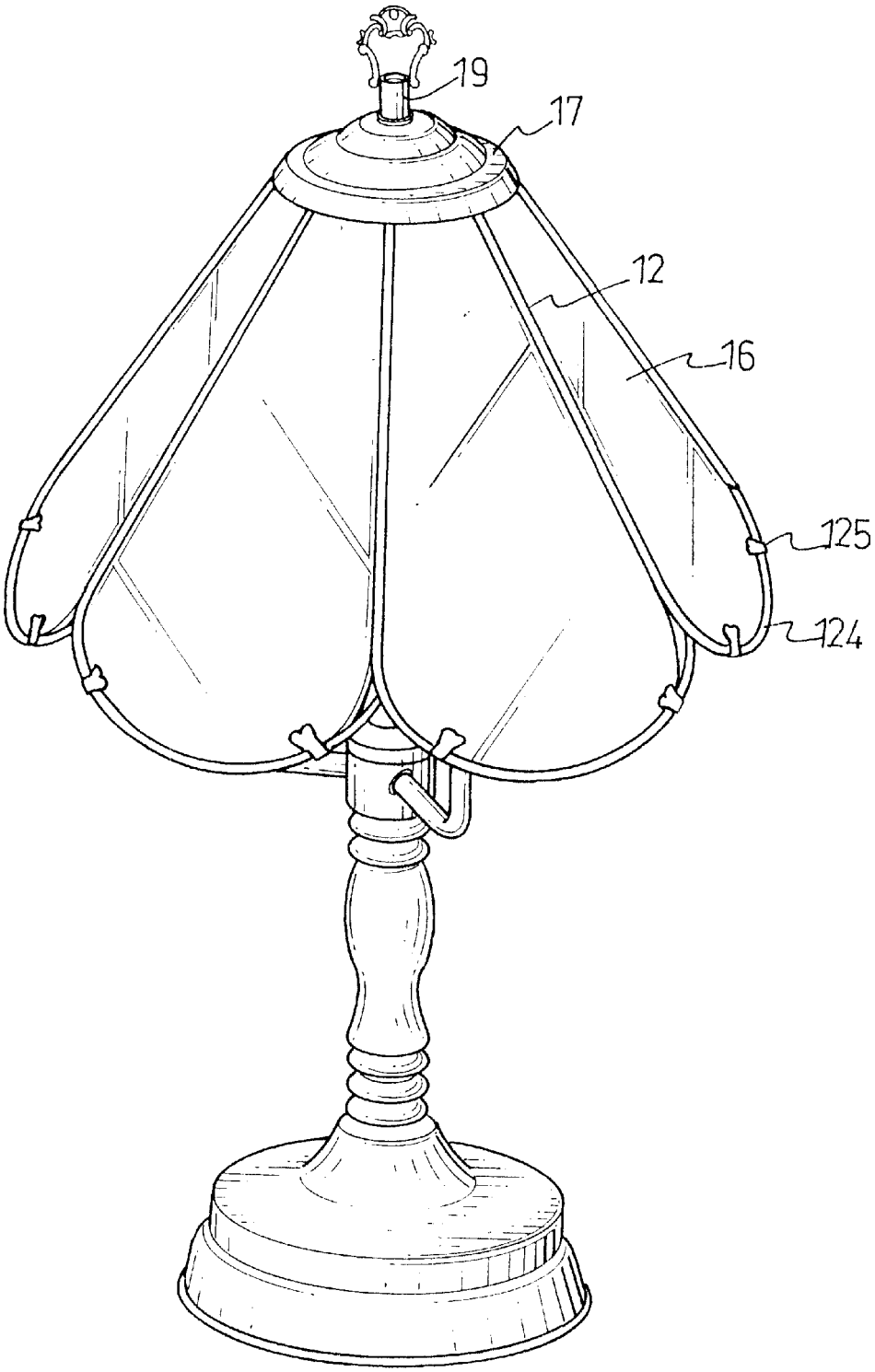
FIG. 1 is a perspective view of a table lamp with a lampshade in accordance with the present invention.
Figure 2:
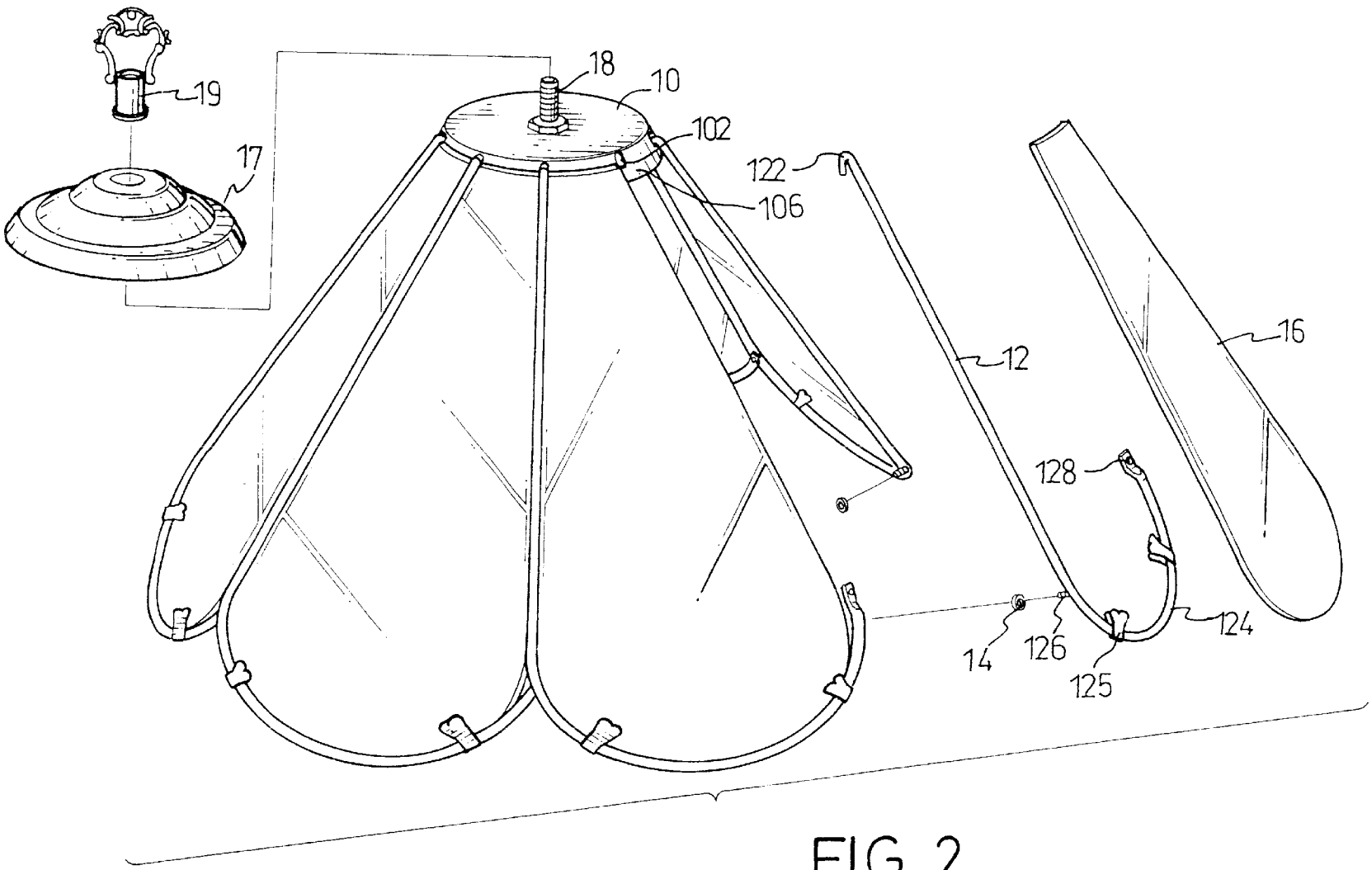
FIG. 2 is a partially exploded perspective view of the lampshade in FIG. 1.
Figure 3:
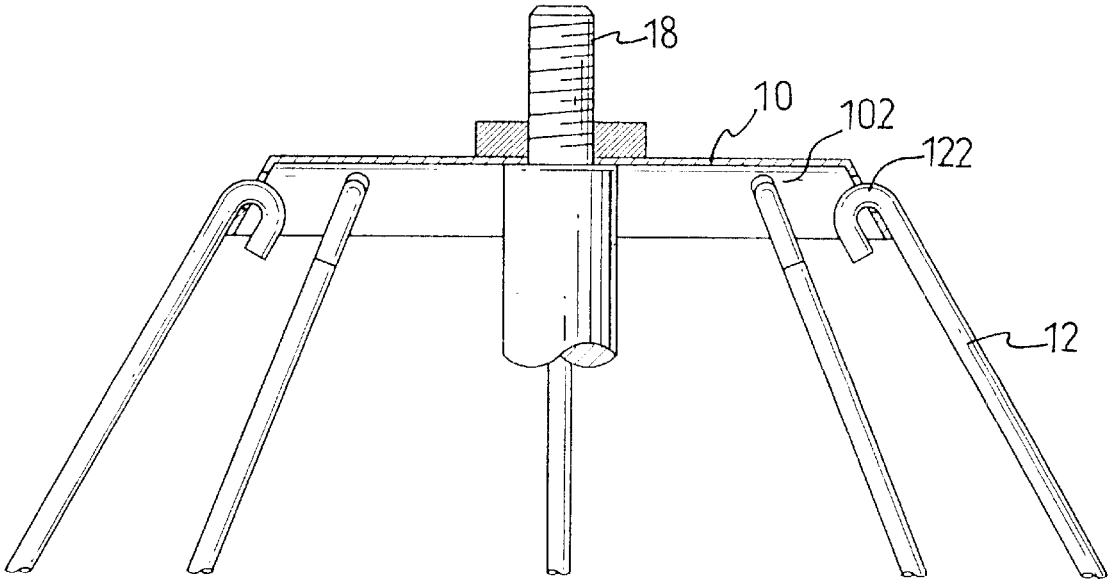
FIG. 3 is an enlarged side plan view in partial section of the top of the lampshade in FIG. 1.
Figure 4:
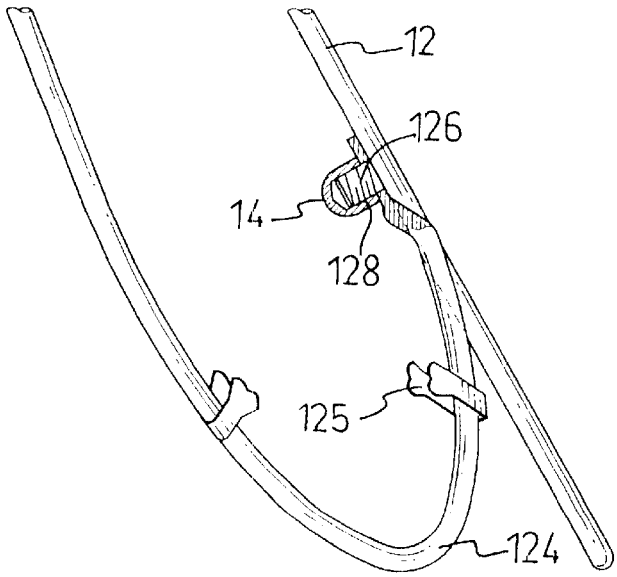
FIG. 4 is an enlarged perspective view in partial section of the joint between adjacent panel frames of the lampshade in FIG. 1.

With reference to FIGS. 1 to 3, a lampshade in accordance with the present invention comprises a top plate (10), multiple panel frames (12) and multiple shade panels (16). The top plate (10) has a skirt (106) formed on the outer edge and a through hole (not numbered) defined in the center of the top plate (10). The top plate (10) is attached to the top of a table lamp. A threaded rod (18) projecting from the top of the lamp extends through the through hole. The top plate (10) has multiple elongated holes (102) which are defined in the skirt (106).

A hook (122) is formed on one end of each panel frame (12) to detachably engage with one of the elongated holes (102) in the top plate (10) skirt (106). In a first embodiment of the lampshade, each panel frame (12) has a straight body. A curved panel support (124) is formed on the other end of each panel frame (12). At least one panel clip (125) is attached to the panel support (124) of each panel frame (12). A through hole (128) is defined in the free end of the panel support (124) of each panel frame (12). A threaded stud (126) extends from each panel frame (12) to pass through the through hole (128) in the adjacent panel frame (12). A nut (14) is screwed onto each threaded stud (126) to secure adjacent panel frames (12). Consequently, a skeletal lampshade frame constructed of the top plate (10) and panel frames (12) is assembled. In practice, the location of the attachment of each panel frame (12) to the adjacent panel frame (12) is where the through hole (128) is defined as flat, and that is where it is attached to the threaded stud (126) on the adjacent panel frame (12). Accordingly, the flat portion of each panel frame (12) corresponds to the shape of the cross section of the panel frame (12), and the volume of the joint between adjacent panel frames (12) is reduced.

Each shade panel (16) is inserted into one of the panel frames (12) and is held by the panel support (124) and the panel clips (125).

To attach the lampshade to a table lamp, the threaded rod (18) extends through the through hole in the top plate (10).

A cap (17) covers the top plate (10) and the top edge of the each shade panel (16) to hold the shade panels (16). A nut (19) is then screwed onto the threaded rod (18). Consequently, the lampshade is secured to the table lamp.

With such an arrangement, because the top plate (10) and each panel frame (12) are assembled by means of the engagement between the elongated hole (102) and the hook (122), the panel frames (12) can be disengaged from the top plate (10). In addition, because adjacent panel frames (12) are assembled by means of the engagement between the threaded stud (126) and the nut (14), the panel frames (12) are also detachable. Consequently, the lampshade can be disassembled into multiple small parts. The package and storage sizes of the lampshade are decreased. To transport or store the lampshade is more convenient. The cost and the space for transporting or storing the lampshade are also decreased.

Figure 5:
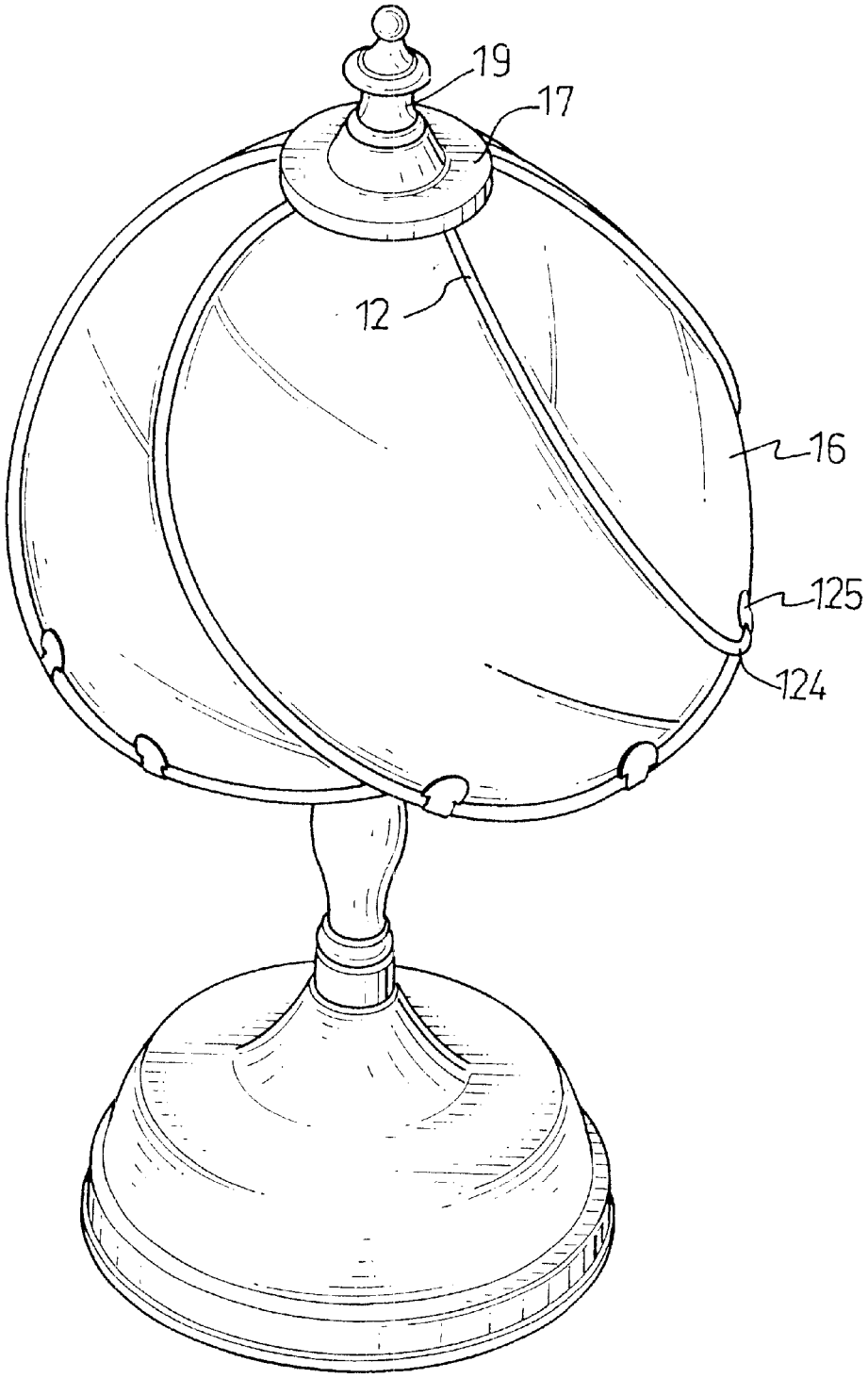
FIG. 5 is a perspective of another table lamp with another embodiment of a lampshade in accordance with the present invention.
Figure 6:
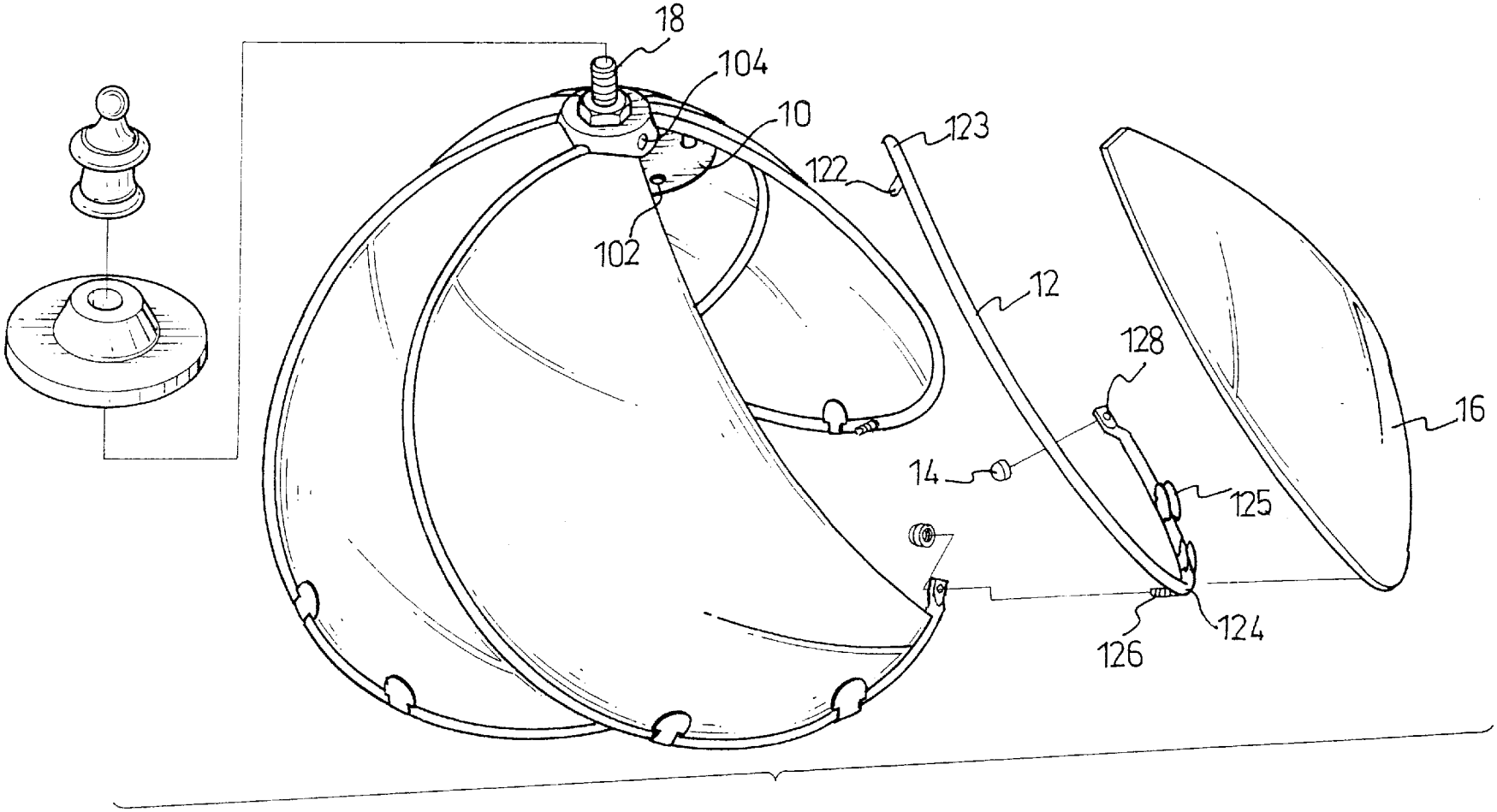
FIG. 6 is a partially exploded perspective view of the lampshade in FIG. 6.
Figure 7:
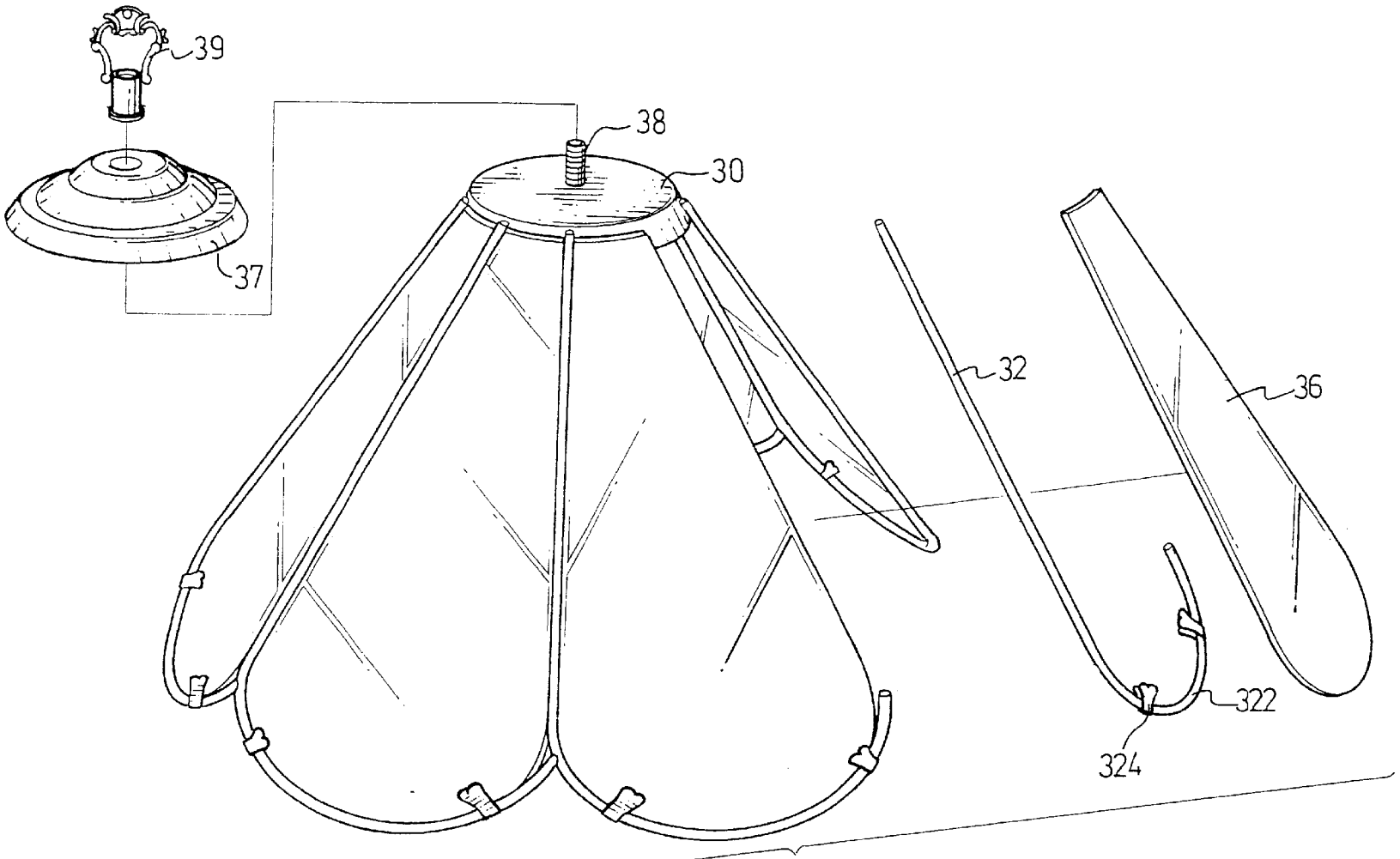
FIG. 7 PRIOR ART
FIG. 7 is a partially exploded perspective view of a conventional lampshade in accordance with the prior art.
Figure 8:
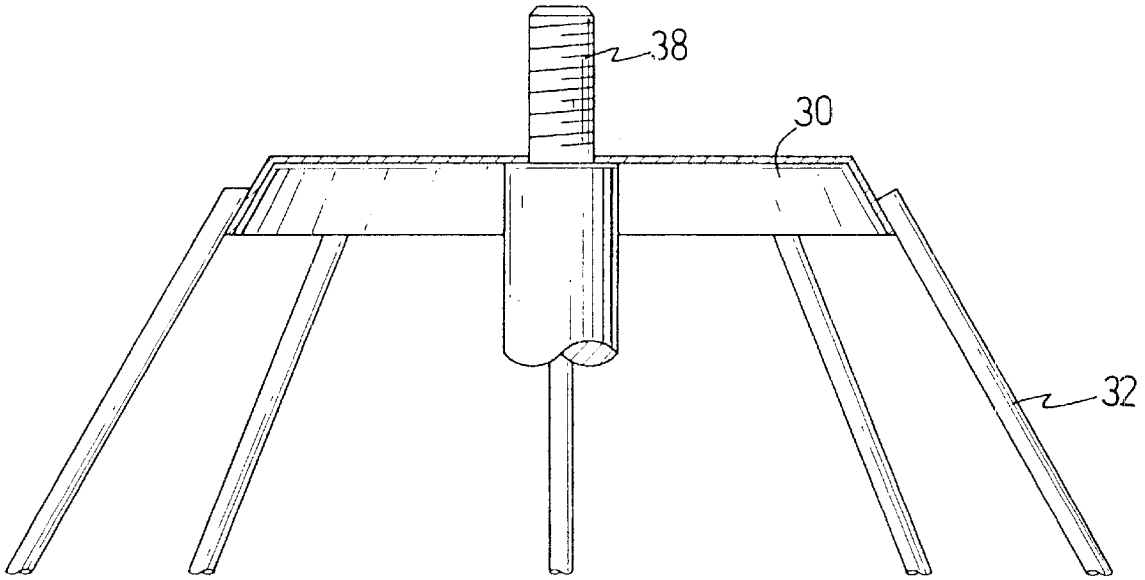
FIG. 8 PRIOR ART
FIG. 8 is an enlarged side plan view in partial section of the top plate of the lampshade in FIG. 7.
Figure 9:
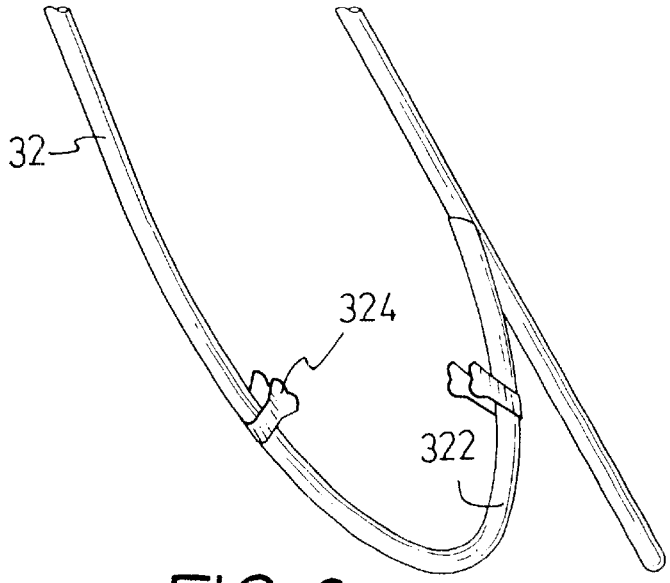
FIG. 9 PRIOR ART
FIG. 9 is a perspective view in partial section of the joint between adjacent panel frames of the lampshade in FIG. 7.

With reference to FIGS. 5 and 6, each panel frame (12) in a second embodiment of the lampshade in accordance with the present invention has a curved body and the panel support (124) is formed on one end of the curved body. A lampshade with a different appearance is achieved due to the change of the shape of the panel frames (12). In addition, the hook (122) is formed on the panel frame (12) near the end opposite to the panel support (124), such that an engaging end (123) is formed on the end of each panel frame (12). A circular hole (104) is defined in the top plate (10) to engage with the engaging end (123) of each panel frame (12). Consequently, the combination between the top plate (10) and each panel frame (12) is enhanced due to the engage engaging end (123) and the circular hole (104).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lampshade for a table lamp, the lampshade comprising:

a top plate adapted to be attached to a top of the table lamp;

a skirt around the edge of the top plate;

multiple elongated holes defined in the skirt;

multiple panel frames each having a hook which detachably engages with one of the elongated holes in the skirt;

a panel support formed on each panel frame and opposite to the hook, the panel support having a through hole defined in the panel support of each panel frame;

at least one panel clip attached to the panel support of each panel frame to support a shade panel inserted into each panel frame;

a threaded stud extending from each panel frame and through the through hole in the adjacent panel frame; and a nut screwed onto each threaded stud to connect the adjacent panel frames.

2. The lampshade as claimed in claim 1, wherein each panel frame has a straight body; and the panel support of each panel frame is curved and formed on one end of the straight body.

3. The lampshade as claimed in claim 1, wherein each panel frame has a curved body; and the panel support of each panel frame is curved and formed on one end of the curved body.

4. The lampshade as claimed in claim 1, wherein the elongated holes are arranged around the skirt of the top plate in a circle.

5. The lampshade as claimed in claim 1, wherein each through hole is defined in a free end of the panel support.

6. The lampshade as claimed in claim 5, wherein a location of each panel frame is where the through hole is defined is flat.

7. The lampshade as claimed in claim 1, wherein a location of each panel frame is where the through hole is defined is flat.

8. The lampshade as claimed in claim 1, wherein the hook is formed on the panel frame at an end opposite to the panel support.

9. The lampshade as claimed in claim 1, wherein the hook is formed on the panel frame near an end opposite to the panel support so as to form an engaging end on each panel frame; and a circular hole is defined in the top plate to engage with the engaging end of each panel frame.

* * * * *